United States Patent [19]

Anthony et al.

[11] Patent Number: 4,876,772

[45] Date of Patent: Oct. 31, 1989

[54] SAFETY BELT BUCKLE

[75] Inventors: James R. Anthony, Carmel; David Merrick, Indianapolis; Ronald F. Homeier, Plainfield; Allan R. Lortz, Carmel, all of Ind.

[73] Assignee: Indiana Mills & Manufacturing, Inc., Westfield, Ind.

[21] Appl. No.: 160,405

[22] Filed: Feb. 25, 1988

[51] Int. Cl.[4] ..... A44B 11/25

[52] U.S. Cl. ..... 24/637; 24/641; 24/643

[58] Field of Search ..... 24/637, 635, 639, 640, 24/641, 642, 643, 638

[56] References Cited

U.S. PATENT DOCUMENTS

| | | | |
|---|---|---|---|
| 3,396,437 | 8/1968 | Burleigh . | |
| 3,440,697 | 4/1969 | Proctor . | |
| 4,121,327 | 10/1978 | Huntley . | |
| 4,127,922 | 12/1978 | Mita . | |
| 4,128,924 | 12/1978 | Happel et al. . | |
| 4,182,008 | 1/1980 | Pouget . | |
| 4,195,392 | 4/1980 | Ueda et al. . | |
| 4,197,619 | 4/1980 | Burleigh . | |
| 4,301,576 | 11/1981 | Cunningham . | |
| 4,313,246 | 2/1982 | Fohl . | |
| 4,358,879 | 11/1982 | Magyar | 24/641 |
| 4,368,563 | 1/1983 | Lentz | 24/637 |
| 4,382,320 | 5/1983 | Yamamura . | |
| 4,385,425 | 5/1983 | Tanaka et al. . | |
| 4,388,746 | 6/1983 | Krautz et al. . | |
| 4,393,557 | 7/1983 | Schmidt . | |
| 4,394,792 | 7/1983 | Schmidt | 24/637 |
| 4,403,376 | 9/1983 | Palloks . | |
| 4,425,688 | 1/1984 | Anthony et al. . | |
| 4,527,317 | 7/1985 | Straszewski et al. . | |
| 4,535,514 | 8/1985 | Grabowski | 24/637 |
| 4,543,693 | 10/1985 | Cunningham . | |
| 4,562,625 | 1/1986 | Doty et al. | 24/643 |
| 4,577,378 | 3/1986 | Harenberg . | |
| 4,587,696 | 5/1986 | Ueda et al. . | |
| 4,611,369 | 9/1986 | Wier . | |
| 4,614,010 | 9/1986 | Charlton et al. . | |
| 4,617,705 | 10/1986 | Anthony et al. . | |
| 4,677,715 | 7/1987 | Escaravage . | |
| 4,677,716 | 7/1987 | Monsigny | 24/641 |
| 4,692,970 | 9/1987 | Anthony et al. . | |

FOREIGN PATENT DOCUMENTS

| | | | |
|---|---|---|---|
| 1589059 | 5/1981 | United Kingdom | 24/642 |

*Primary Examiner*—Victor N. Sakran

*Attorney, Agent, or Firm*—Woodard,Emhardt,Naughton Moriarty & McNett

[57] ABSTRACT

A seat belt buckle has a plastic outer body of a color and style suitable for the intended environment, with a formed steel inner frame having horizontally-spaced upturned sides having two parallel pairs of inturned flanges serving as crush inhibitors, release slide guides, and tongue receiver guides. An upturned frame front flange cooperates with the sides and flanges as a wrack resistor and tongue retainer. The body front has a trough-shaped entrance to admit a latchable tongue, one margin of the entrance being provided by the sloped front of an end-release operating slide. A removable slide front button is curved to assist finding for release. A pivoting latching pawl is spring-urged into latching position, and released by a cam on the slide, with a shallow ramp for ease of intentional release. A tongue ejector holds the pawl in unlatched position when the tongue is out of the buckle.

24 Claims, 4 Drawing Sheets

SAFETY BELT BUCKLE

BACKGROUND OF THE INVENTION

1. Field of the Invention

This invention relates generally to safty belt buckles, and more particularly to a buckle having a release slide with end-operated release button.

2. Description of the Prior Art

Safety belt buckles are marketed in a great variety. In recent years, perhaps the largest volume of buckles has been used for seat belts in the transportation industry, a portion of that being in motor vehicles. Some of the problems associated with safety belt buckles include user difficulty installing the belt tongue in the buckle, inadvertent release by the user bumping the release button, premature release due to inertial effects or deformation during a collision, and crushing damage to a buckle which has fallen into a position where it is exposed to damage by closing a vehicle door on the buckle or forcing a foldable seat onto it. The present invention is the result of efforts addressed to overcoming these problems.

SUMMARY OF THE INVENTION

A buckle according to a typical embodiment of this invention includes a body, a cover and a frame inside the body and cover. The buckle frame has a base, parallel walls upstanding from the base and spaced to admit a latchable tongue therebetween, and two pairs of coplanar inturned side flanges on the walls. A pivoting latch plate mounted to the walls above the base, has a latching pawl projecting upward thereon. One of the flange pairs, co-operating with the frame walls and a front flange upturned from the base, define an entrance for a latchable tongue. The latch plate being pivotable on the frame, enables the latching pawl to move upward into a latching position to interfere with movement of a belt tongue through the entrance. A spring urges the plate to move the pawl to the interfering position. The two pairs of flanges define a guideway for a manually-operable tongue release slide which has a pawl release cam ramp thereon, the slide having a rest position and a release position, and normally biased to the rest position.

The latch plate has a cam follower arm engageable by the cam ramp when the slide is moved from the rest position to the release position to move the latching pawl out of the latching position.

A stop on the cam follower arm, and a boss on the slide, are abuttingly engageable with each other when the buckle is latched, to prevent movement of the pawl out of the latching position when the tongue is latched, until intentionally released. The slide has a convex end face for manual operation to the release position, and a snap-on cap to color-match the cover.

BRIEF DESCRIPTION OF THE DRAWINGS

FIG. 8 is a view similar to. FIG. 5 but showing the buckle in the latched condition.

DESCRIPTION OF THE PREFERRED EMBODIMENT

Figure 1:
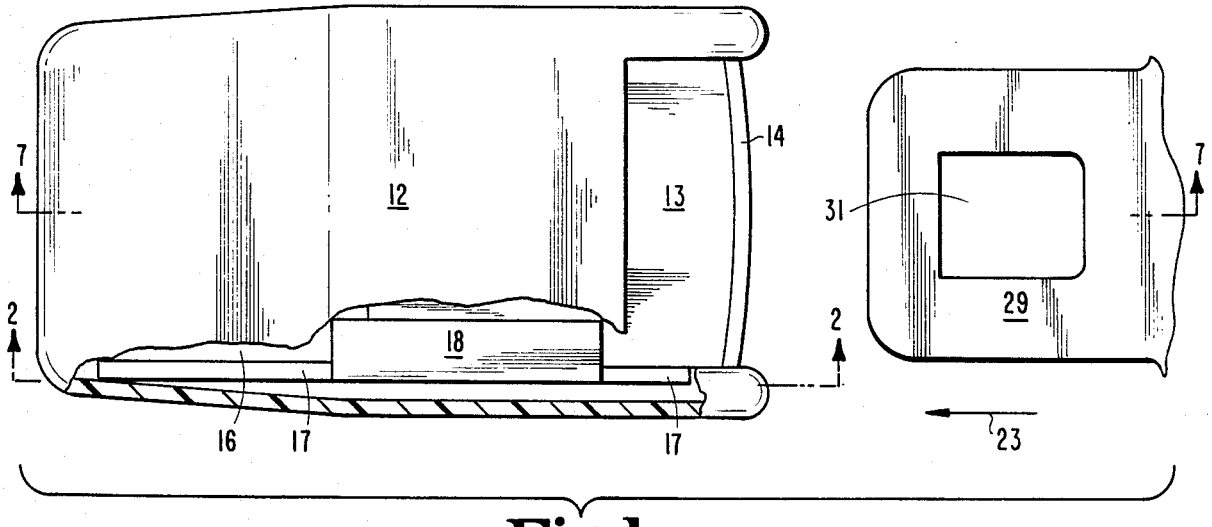
FIG. 1 is a top plan view of a safety belt buckle, with a belt latching tongue (shown fragmentally) positioned for insertion into the buckle, a portion of the buckle cover being broken out to show the buckle frame inside.

Referring now to the drawings in detail, the exterior features of the buckle assembly include a body 11, cover 12, and release button slide 13 and button front 14. These are all typically made of plastic and may be of a color or colors selected for desired esthetic effect. A buckle frame made of stamped steel is mounted in the body and includes a base 16, parallel upstanding sidewalls 17, a first pair of co-planar inwardly-turned and facing flanges or ears 18, (FIGS. 1 and 10) and a second lower or intermediate pair of co-planar inwardly turned and facing flanges or ears 19. The frame has a front flange 21 turned up from the base at the front and having an upper edge 22 which defines the lower edge of an entrance for a belt tongue inserted in the direction of arrow 23.

Figure 7:
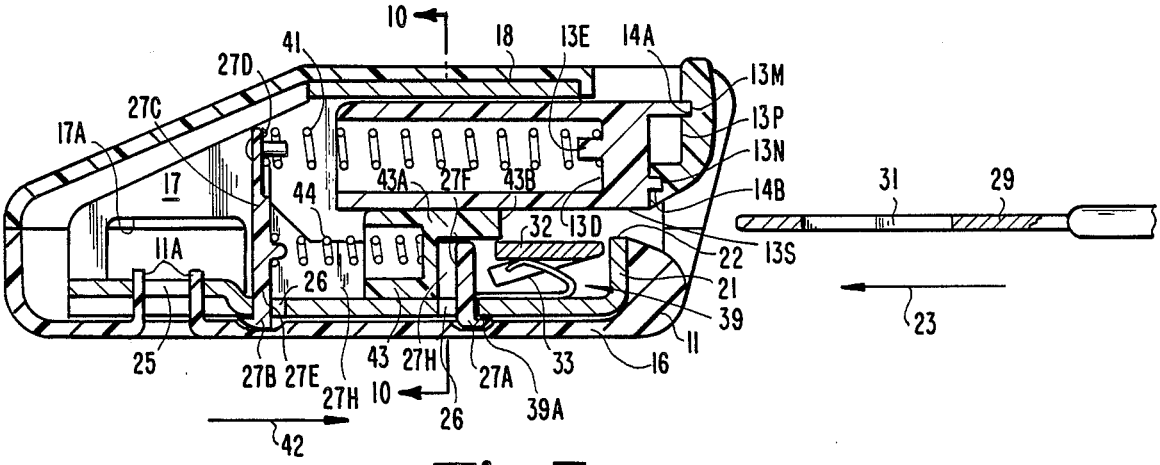
FIG. 7 is a longitudinal section through the buckle taken at line 7—7 in FIG. 1 and viewed in the direction of the arrows.

The frame sidewalls, which are essentially identical to each other, have pawl pivot apertures 24 therein. The base 16 has several centrally located rectangular apertures (FIG. 7). One of these is the belt connecting aperture 25. The other two are ejector holder mounting apertures 26 receiving the front and rear latching feet 27A and 27B of the ejector holder 27. Shallow recesses are provided in the top surface of the bottom of the buckle body to receive and provide clearance for the latching lugs at the feet of the ejector holder.

Figure 8:
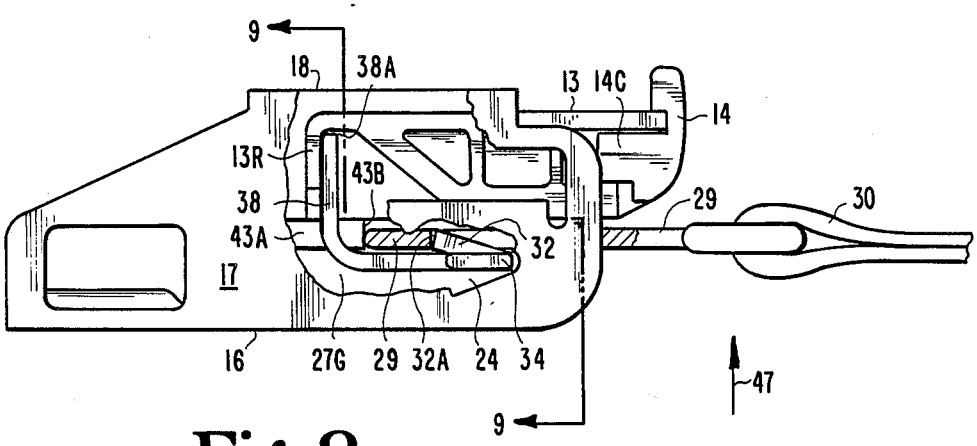

A conventional belt latching tongue can be used with this buckle and typically includes a steel plate 29 having some non-abrasive cushion coating around the belt mounting portion, the latter having an aperture through the coating and plate to receive the belt 30 (FIG. 8) through it. A latching aperture 31 in the tongue plate receives a latching pawl 32 when the tongue is installed in the buckle as shown in FIG. 8. The pawl 32 is formed on the top front end of a latching plate 33. The latching plate has a pair of pivot posts 34 (FIG. 2), one at each side, and each of which is received in one of the pawl pivot apertures 24 in the frame walls 17. Because of the substantial length of these pivot posts in the direction from the front pivoting edge 36 thereof to the rear edge 37, all of which is integral with the latch plate itself 33 and directly adjacent the pawl 32, they are very strong and well able to withstand any tongue loading that can be expected to be applied to them while the buckle is in the latched condition. The latching plate 33 has an upturned rear arm 38 with a cam follower surface at its upper front edge 38A.

The latching plate, and thereby pawl 32, is biased in a clockwise direction by a leaf spring 39 (FIGS. 5 and 7) whose upper curved portion is received and directly engages the latching plate in a concavity directly under the pawl. The base of the spring rests on the base of the frame, and has end 39A which hooks around the front edge of the front hole 26 in the base, and is sandwiched and held in place by ejector holder latching foot 27A.

The pawl release slide 13 has flat, horizontally spaced, co-planar longitudinally extending bottom surfaces 13A and 13B (FIGS. 3,5,6 and 10) which are slidably received on top of the frame flanges 19. The normal forward rest position for this slide when the belt tongue is unlatched is shown in FIGS. 1–5 and 7 where it is urged forward by a release return coil spring 41 urging the slide forward in the direction of arrow 42. Forward movement in that direction is stopped by engagement of the front face of a boss 13C (FIGS. 4 and 5) of the slide with the upper rear edge 38B of the latch plate arm 38. The rear support for the release return spring 41 is provided by an upstanding post 27C integral with the rear end of ejector holder 27. The spring seats in pocket 27D, centered on a pin mounted to the post 27C at the center of the pocket. The front end of the spring is seated on wall 13D at the front of a rearward-opening spring housing cavity in the slide 13, and is centered on integral pin 13E (FIGS. 4 and 7) at the front wall.

Figure 10:
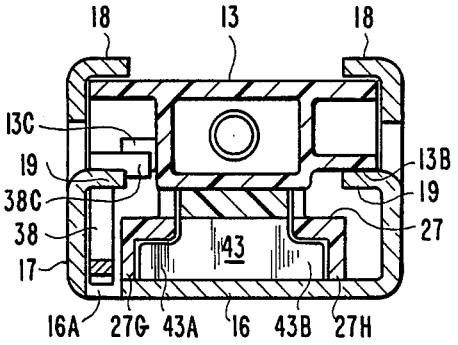
FIG. 10 is a cross section taken at line 10—10 in FIG. 7 and viewed in the direction of the arrows.
Figure 11:
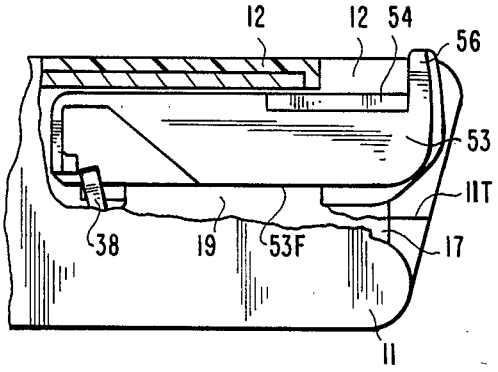
FIG. 11 is a fragmentary view similar to FIG. 5 but including also the body and cover as in FIG. 7, and showing a preferred embodiment of the buckle release slide and cap.

The ejector holder 27 has the spring seat post 27C and rear latching foot 27B at the top and bottom, respectively, of a rear wall 27E. It has front latching foot 27A at the bottom of front wall 27F. The ejector holder is made of a durable, low-friction plastic, having some resilience so that the front and rear feet can be pressed toward each other sufficiently during assembly to enter the holes 26, and then released to snap into secure engagement with the front and rear margins of the front and rear holes, respectively, with the hook portions of the feet retaining the feet on the base. The two longitudinally extending side walls 27G and 27H (FIGS. 4 and 10) of the ejector have inverted L-shapes providing a longitudinally extending groove which is of an inverted T-shape as best shown in FIG. 10 and which guidingly receives the ejector 43, which has laterally projecting lower side flanges 43A and 43B received in the groove of the ejector holder 27. The ejector is also made of a durable low-friction plastic and is biased forward by a coil spring 44 (FIG. 7) whose rear end is received around the projecting boss and seated on the rear wall 27E of the ejector holder. The spring 44 extends forward under spring 41 through the open space 46 (FIG. 4) between walls 27G and 27H of the ejector holder into the spring pocket in the rear of the ejector and seats on the front wall of the pocket. The ejector has a forwardly extending head 43A with a front end 43B which faces the approaching belt tongue.

Figure 3:
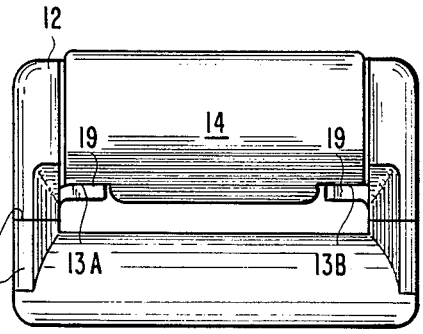
FIG. 3 is a front end view of the buckle.

To aid insertion of the belt tongue into the buckle entrance, guidance is available from the inclined faces of the release button front at the top of the entrance, the cover and body front at the sides of the entrance, and the body front at the bottom of the entrance, which inclined faces co-operate to form a sort of entrance trough (as indicated in FIGS. 3 and 7). Having passed the entrance guide trough, the tongue will continue to be guided by the inside faces of the side walls 17, the bottom face 13S of the release slide, and the upper edge 22 of front flange 21. The leading edge of the tongue will engage the front end 43B of the ejector and push it to the rear against the bias of the spring 44. As soon as the latching aperture 31 of the tongue passes the rear end 32A of the pawl, the pawl return spring 39 will force the pawl upward into latching position in the aperture 31. This condition is shown in FIG. 8. As arm 38 of latching member 33 rises, edge 38B moves up and off of the boss 13C permitting the release slide to move forward slightly under the urging of the spring 41. This forward return movement of the release slide is stopped by abutment of the downwardly extending rear flange 13R of the slide with the rear surface of the latch plate arm 38.

Figure 2:
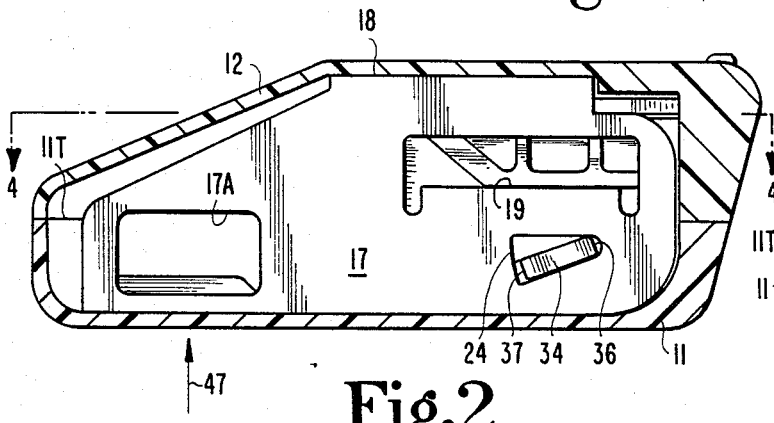
FIG. 2 is a longitudinal section taken at line 2—2 in FIG. 1 and viewed in the direction of the arrows, with the buckle in the open, unlatched condition.
Figure 9:
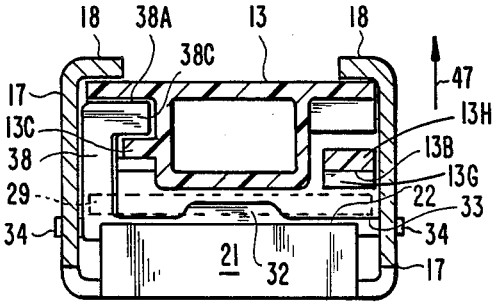
FIG. 9 is a cross section taken at line 9—9 in FIG. 8 and viewed in the direction of the arrows and showing the removable latching tongue in dotted lines.

To prevent inadvertent release of the pawl in response to large accelerations perpendicular to the buckle such as in the direction of the arrow 47 in FIG. 2, a pawl lock catch is provided by the boss 13C as it projects out from the release slide between the release cam surface 13F and the slide rear end flange 13R and, in fact, projects forwardly from the lower edge of flange 13R (FIG. 5) and laterally outward from the spring cavity wall of the slide (FIGS. 9 and 10). The latch plate arm 38 has an inwardly projecting wing 38C (FIGS. 4, 9 and 10) which projects inwardly over the top of the pawl lock catch when the release button is in the normal rest position with the buckle latched as shown in FIGS. 8 and 9. In the event of acceleration of the buckle frame in the direction of arrow 47 enough to overcome the latching force of the pawl return spring 39, the relative movement of the pawl opposite direction of arrow 47 is stopped by the abutting engagement of the bottom edge of wing 38C of the latch plate arm 38 with top of the pawl lock catch boss 13C.

In order to release the tongue, it is necessary to move the pawl down out of the aperture 31 in the tongue. For this purpose, the downwardly and rearwardly facing release cam surface 13F (FIGS. 3, 5 and 8) is provided on the slide and is engageable with the cam follower surface 38A as the slide is pushed to the rear in the direction of arrow 23 (FIG. 1). Pushing the slide to the rear causes the cam to drive the follower down, thus pivoting the latching plate 33 in a counterclockwise direction about the pivot edge 36 and against the urging of the spring 39. As the pivoting occurs, the pawl moves out of the aperture 31. When this occurs, the ejector slides forward (arrow 42 in FIG. 7) as forced to do so by the spring 44, pushing the tongue out of the buckle. It is sufficiently forceful to eject the tongue completely out, even though the ejector travel is limited by the front end wall 27F of the ejector holder. As the ejector pushes the tongue out, the front end 43B of the ejector head moves over the top of the depressed pawl as it is shown beginning to do in FIG. 7. Since the ejector's lateral flanges 43A and 43B remain confined by the ejector holder, the ejector does not move upward as it could otherwise do as a result of the return force of spring 39 urging of the latching plate upward at the pawl. Instead, the ejector head 43A holds the latching plate down. This condition persists until the tongue 29 is re-inserted to push the ejector back but, at that time, the tongue will maintain the latching pawl depressed until the latching aperture 31 has moved in far enough for the pawl to rise into latching position of FIGS. 8 and 9 again. The maintenance of the pawl in the depressed unlatching position makes it easy to insert the tongue and, consequently, reduces wear on the tongue and pawl.

The downward slope of the buckle entrance front surface of the body 11, which starts downward immediately in front of the frame front flange 21, minimizes the likelihood that a coin or other foreign object can become lodged in the buckle entrance. The upper rear end of the body front surface at the buckle entrance at front frame flange edge 22 (FIG. 7) is preferably less than 0.625 inches from the front end 43B of the ejector head when the ejector is in the rest position. Nevertheless, if it somehow happens that the ejector is pushed back (other than by the entering tongue) to the point where it will uncover the pawl, the pawl may rise and inhibit subsequent insertion of the tongue. This can be overcome by manually pushing the release button to the rear in the normal way to pivot the pawl down out of the way as the tongue is inserted.

The arrangement of the components, and particularly the slope of the cam 13F, distance of the cam follower edge from the pivot edge 36, location of the pawl edge 32A from the pivot edge, is such as to give a 4 to 1 mechanical advantage to the user pushing the end of the button 14 to release the buckle. Also it provides a half inch button travel from the latching rest position of FIG. 8 to a pawl release position shown dotted in FIG. 5. This is in a buckle whose overall dimensions are about 3.2 inches long, 1.2 inches high and 1.8 inches wide. This relatively significant button travel for release minimizes the chance of inadvertent release by the user. Use of the pivoting pawl and low-friction materials such as Teflon for the slide and ejector contribute to the ease of operation. The formed steel frame with the inwardly folded lower flanges 19 and upturned front flange 21 support the tongue during prying loads. The inwardly folded upper flanges 18 increase crush resistance and enhance protection of the internal components.

A further feature of the invention pertains to the button front. As shown in FIGS. 3 and 5–8, the lower portion of the button front 14 is sloped inward to provide the upper wall of the entrance "trough." In this embodiment, this button front is a cap distinct from the rest of the slide and has two slots 14A and 14B (FIG. 7) in a rear face thereof which receive mating features 13M and 13N respectively of the slide, 13M being the front edge of the top of the slide, and 13N being a rib on the front wall of the slide. Side-located catch tabs 14C project rearward from the button front, and have inwardly projecting catch shoulders 14D received in side opening cavities at the front of the slide, whereby the tabs are latched to the rear faces of the front walls 13L of the cavities. The material of the button front cap 14 can be a plastic identical in color and composition to that of the body 11 and cover 12. ABS material is an example. The tabs 14C are flexible enough to permit spreading them to install the front cap 14 on the slide, but resilient and stiff enough to remain firmly in place, once installed. This feature enables standardization of the internal components of the buckle, including the slide, but using outer materials for the body, cover and slide front cap as specified by the customer of the buckle manufacturer. The front of the cap 14 is convex curved or crowned as shown best in FIG. 1, which facilitates finding it by feel in the dark. The separability of the cap 14 from the slide, as just described, enables not only choice of color but also a different style front.

Figure 4:
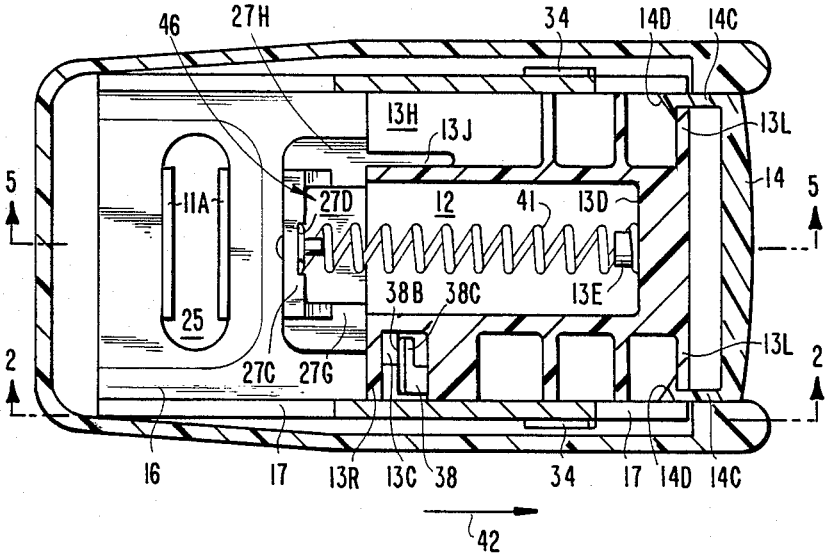
FIG. 4 is a section taken at line 4—4 in FIG. 2 and viewed in the direction of the arrows.

Another feature facilitating standardization is the provision of the apertures 17A in the side walls of the frame, and the rise with aperture 25 in the rear of the base as shown in FIGS. 4 and 7. The body 11 and cover 12 are joined by ultrasonic welding or other suitable means at the line 11T (FIGS. 2 and 3). In the illustrated embodiment, the body has a bottom rear opening with upwardly extending tabs 11A received in the aperture 25 of the frame base. This enables anchoring the buckle to a belt attachment fitting entering the bottom. Alternatively, if it is desired to use a fitting entering the side, a body with side openings in registry with the frame openings 17A, can be used.

Figure 5:
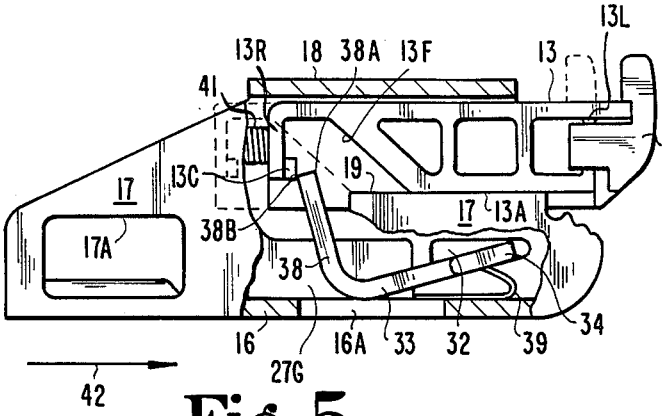
FIG. 5 is a side elevational view with the body and cover removed, and a portion of the frame side broken out to show interior details.
Figure 6:
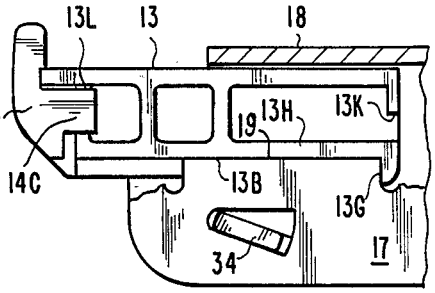
FIG. 6 is a fragmentary view of the side opposite that in FIG. 5, and showing the release slide return travel stop.

A slot 16A is provided in the base 16 to accommodate the lower end of arm 38 of the latch plate when it is pushed down to the position of FIG. 5 by operation of the release slide. Rearward travel of the slide will be stopped by engagement of the upper rear wall of the button front with the front edge 12A of the cover 12. If it somehow happens that, after the slide returns to the unlatch rest position of FIG. 5, the latching plate is bumped downward relative to the slide, and disengages the stop boss 13C, the slide return spring 41 will force the slide forward. It would exit completely from the buckle except for a stop shoulder 13G (FIGS. 6 and 9) at the bottom rear of the right hand side of the slide, and which will abuttingly engage the rear end of the flange 19. That shoulder is located at the rear end of the slide bearing extension arm 13H (FIGS. 4, 6 and 9). If it is desired to remove the slide from the frame while the buckle body and cover are off, this arm can be resiliently bent upward relative to the slide and the flange 19, since there is a slot 13J (FIG. 4) between this arm and the slide spring cavity wall, so the arm is cantilevered from the part of the slide directly in front of it, and is not attached at the side of the slide. When the rear end of the arm is bent upward, then the shoulder 13G will clear the rear end of the flange 19 and permit removal of the slide from the frame. Re-installation can be done by likewise bending the arm upward to clear the front edge of the flange 19.

Figure 12:
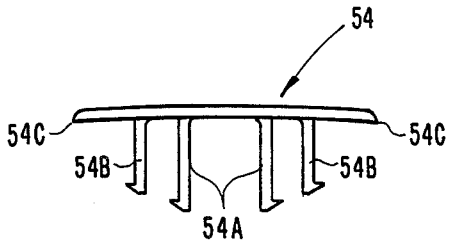
FIG. 12 is a rear elevational view of the release button top cap.
Figure 13:
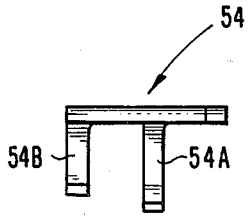
FIG. 13 is a side elevational view of the release button top cap.
Figure 14:
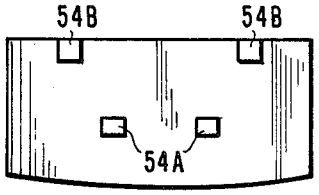
FIG. 14 is a bottom view of the release button top cap.
Figure 15:
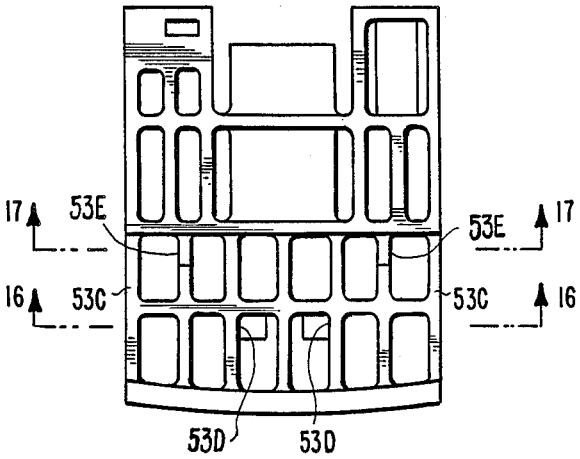
FIG. 15 is a top plan view of the release slide without the top cap.
Figure 16:
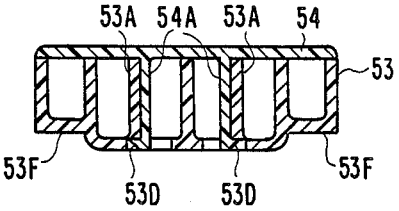
FIG. 16 is a section through the release slide assembly taken at the location of line 16—16 in FIG. 15 and viewed in the direction of the arrows and showing the cap latched in place.
Figure 17:
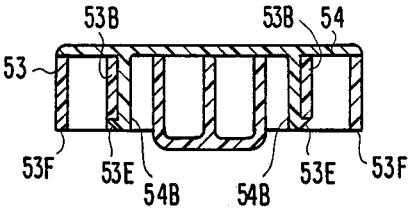
FIG. 17 is a section through the release slide assembly taken at line 17—17 in FIG. 15 and viewed in the direction of the arrows and showing the cap latched in place.

Referring to FIGS. 11–17, a preferred embodiment of release slide is shown at 53. Instead of having the closed top and bottom with open side construction as in slide 13, the slide 53 is more open at the top and closed at the sides. This enables snap-on mounting of cap 54 on the top of the slide immediately behind the upstanding front flange 56 which, on the first-described embodiment, was part of the snap-on front end cap 14. To be specific, the cap 54 has two front legs 54A and two rear legs 54B. Each of these has an outwardly directed shoulder adjacent its lower end as best shown in FIG. 12. These shoulders slide downward along the vertical web walls 53A and 53B of the slide 53 as the cap is pushed down onto the slide, until the shoulders reach the lower edges of the webs, whereupon the legs resiliently snap outward, and the shoulders move out under the lower edges of the webs.

It can be seen in FIG. 12, that the cap has a slight crown. The lower outer edges first contact the outboard top surface 53C of the slide. As the cap is finally pushed flat into place, the leg shoulders snap out under the lower edges of walls 53A and 53B. When the cap installing force is released, the stress introduced in the cap as the crown was pushed flat, serves to pull upward on the legs 54A and 54B and thereby resiliently and tightly hold the latching shoulders against the bottom edges of the web walls 53A and 53B at 53D and 53E, respectively. The bottom surfaces 53F of the slide 53 are slidably received on the top of the frame flanges 19 as in the first-described embodiment. The slide 53 thus operates in all respects as described above with reference to slide 13. The advantage of this embodiment is that the slide can be a bright color such as red or orange in all frame assemblies in production quantities. But where various decorative colors are to be used for the body and cover, the top of the slide can be covered with a cap of matching color. The only portion displaying the bright color is the end which is to be pushed to release the tongue. For example, in the buckle assembly of FIG. 11, with the body and cover 12 colored blue, the cap 54 is a matching blue, but the slide 53 and its exposed front face is a bright red, making it easy for the user to see where to push to unlatch the tongue. The same standardized frame and slide, without cap, can be adapted to any desired color scheme by selecting the desired body, cover and cap.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A buckle comprising:

a body having an entrance to admit a latchable tongue;

a latch member in said body and having a latching pawl thereon;

said latch member being pivotable in said body to enable said latching pawl to move into a latching position to interfere with movement of a tongue through said entrance;

guide means in said body defining a guideway for a release slide;

a release slide received in said guideway and having a pawl release cam thereon, said slide having a rest position and a release position, and normally biased to said rest position;

resilient means mounted between said body and said latch member and operating independently of said release slide and urging said pawl to said latching position;

said latch member having a cam follower engageable by said cam when said slide is moved from said rest position to said release position to move said latching pawl out of said latching position; and a spring loaded ejector behind said entrance and in the path of a latchable tongue when inserted through said entrance, and operable between a cocked position and a rest position;

said ejector being movable along a path traveled by the tongue as the tongue is moved into the body through said entrance, and returnable along said path as the tongue is removed from the body.

2. The buckle of claim 1 wherein:

said ejector includes a front portion directly and abuttingly engageable with the end of said tongue as the tongue is inserted in the entrance, said ejector being resiliently biased to resist entrance of the tongue, said front portion being immediately above said latch pawl and is movable over said latch pawl when said tongue is removed, to intercept said latch pawl as the tongue is removed from the buckle to prevent said pawl from moving into said latching position during absence of the tongue from the buckle.

3. The buckle of claim 2 and further comprising:

a return spring in said body and biasing said ejector toward said entrance to forceably eject said tongue from said entrance when said pawl is moved out of latching position.

4. The buckle of claim 1 wherein:

said release slide includes unlatch blocker means located in abutting relation with a pawl lock portion of said latch member when said pawl is in said latching position and said release slide is in said rest position to prevent said pawl from moving out of said latching position in response to acceleration of said body in a direction transverse to said path.

5. The buckle of claim 1 wherein:

said ejector is slidable in the direction of said tongue entrance path and includes a pawl control portion disposed over a part of said latch member when said latch member is in the pawl unlatching position and said slide is near said rest position to prevent movement of said latch to said latching position when said tongue is out of said body and said ejector is pushed rearwardly from said rest position thereof.

6. The buckle of claim 1 wherein:

said slide includes a button having a front end which is convex about an axis perpendicular to a plane which contains the pivot axis of said latch member and is parallel to said path, for manipulation by the user of the buckle.

7. The buckle of claim 6 wherein:

said body and button are shaped to form a trough at said entrance, the trough including generally facing side walls of said body converging toward said entrance at the sides of said entrance, and a front wall of said body sloping upward and rearward toward said entrance at the bottom of said entrance, and a wall of said button sloping downward and rearward from said convex front end toward said entrance at the top of said entrance.

8. The buckle of claim 7 wherein:

the upward sloping front wall has an upper end at said entrance and which is located close to the front end of the ejector when said ejector is in the rest position thereof to inhibit collection and retention of foreign objects in said path in said buckle when said tongue is absent from the buckle.

9. The buckle of claim 8 wherein:

the upward sloping front wall has an upper end at said entrance and which is located less than 0.625 inches from the front end of the ejector when said ejector is in the rest position thereof.

10. The buckle of claim 1 and further comprising:

a frame in said body and including a base and a pair of spaced parallel side walls upstanding from said base, and a pair of horizontally-spaced flanges extending inwardly from said side walls in position to support the top of said body.

11. The buckle of claim 10 and wherein said frame includes:

a front flange extending upwardly to said entrance.

12. The buckle of claim 10 and wherein said frame includes:

a second pair of horizontally-spaced flanges extending inward from said walls below said first pair and cooperating with said first pair to provide said guide means.

13. The buckle of frame 12 and further comprising:

a front flange extending upward from said base to said entrance and terminating at an upper edge spaced below the flanges of said second pair to co-operate with said flanges to provide upper and lower margins of a tongue receiver and prevent disorientation of the tongue when it is received in said entrance.

14. The buckle of claim 13 and wherein:

said frame is formed of one homogeneous piece of steel.

15. A buckle comprising:

a body having an entrance to admit a latchable tongue;

a latch member in said body and having a latching pawl thereon;

said latch member being pivotable in said body to enable said latching pawl to move into a latching position to interfere with movement of a tongue through said entrance;

resilient means urging said pawl to said latching position;

guide means in said body defining a guideway for a release slide;

a release slide received in said guideway and having a pawl release cam thereon, said slide having a rest position and a release position, and normally biased to said rest position;

said latch member having a cam follower engageable by said cam when said slide is moved from said rest position to said release position to move said latching pawl out of said latching position; and a spring loaded ejector behind said entrance and in the path of a latchable tongue when inserted through said entrance, and operable between a cocked position and a rest position;

said ejector being movable along a path traveled by the tongue as the tongue is moved into the body through said entrance, and returnable along said path as the tongue is removed from the body;

said release slide includes unlatch blocker means located in abutting relation with a pawl lock portion of said latch member when said pawl is in said latching position and said release slide is in said rest position to prevent said pawl from moving out of said latching position in response to acceleration of said body in a direction transverse to said path;

said latch member including an upwardly extending arm, said arm having a horizontal offset at its upper end, said pawl lock portion being on said offset, said blocker means being a boss on said release slide and movable into position immediately below said pawl lock portion when said slide moves forward to said rest position.

16. The buckle of claim 15 wherein:

there is a stop on said arm and a stop on said slide, said stops being abuttingly engageable with each other when said pawl is in said latching position to prevent movement of said slide out of said buckle.

17. The buckle of claim 15 wherein:

said arm has said cam follower at the top thereof, said pawl lock portion being under said cam follower, said blocker means boss being near the bottom of said slide and movable out from under said lock portion when said slide is pushed rearwardly from said rest position.

18. A buckle comprising:

a frame having a base, walls upstanding from said base and spaced to admit a latchable tongue therebetween;

a latch member mounted to said frame above said base, said member having a latching pawl thereon;

a first pair of co-planar flanges, one of said flanges being located on each of said walls above said base and said latch member and co-operating with said walls and said latch member to define an entrance for a latchable tongue, said latch member being pivotable on said frame to enable said latching pawl to move into a latching position to interfere with movement of a tongue through said entrance;

a resilient member urging said pawl to said latching position;

a second pair of co-planar flanges, one of said flanges being located on each of said walls and spaced above the flange of the first pair;

said first and second pairs of flanges defining a guideway for a release slide, and a release slide received in said guideway and having a pawl release cam ramp thereon, said slide having a rest position and a release position, and normally biased to said rest position.

19. The buckle of claim 18 and further comprising:

a spring normally urging said slide to said rest position; and a stop on said slide engageable with an edge of one of said flanges of said second pair to limit travel of said slide effected by the urging of said spring.

20. The buckle of claim 19 wherein:

said slide has a cantilever mounted rearward extending arm thereon, said stop being a downward projecting shoulder at a distal end of said arm, said arm being normally slidable on said one flange and said shoulder being abuttingly engageable with a rear end of said one flange during forward movement of said slide to stop said slide.

21. The buckle of claim 20 wherein:

said arm is resiliently bendable for upward movement of said shoulder relative to said flange to disengage said shoulder from said flange end for intentional forward removal of said slide from said guideway.

22. A buckle comprising:

a body having an entrance to admit a latchable tongue;

a latch member in said body and having a latching pawl thereon;

said latch member being pivotable in said body to enable said latching pawl to move into a latching position to interfere with movement of a tongue through said entrance;

resilient means urging said pawl to said latching position;

guide means in said body defining a guideway for a release slide;

a release slide received in said guideway and having a pawl release cam thereon, said slide having a rest position and a release position, and normally biased to said rest position;

said latch member having a cam follower engageable by said cam when said slide is moved from said rest position to said release position to move said latching pawl out of said latching position;

said release slide including unlatch blocker means located in abutting relation with a pawl lock portion of said latch member when said pawl is in said latching position and said release slide is in said rest position to prevent said pawl from moving out of said latching position in response to acceleration of said body in a direction transverse to said path;

said latch member including an upwardly extending arm, said arm having a horizontal offset at its upper end, said pawl lock portion being on said offset, said blocker means being a boss on said release slide and movable into position immediately below said pawl lock portion when said slide moves forward to said rest position.

23. The buckle of claim 22 wherein:

there is a stop on said arm and a stop on said slide, said stops being abuttingly engageable with each other when said pawl is in said latching position to prevent movement of said slide out of said buckle.

24. The buckle of claim 22 wherein:

said arm has said cam follower at the top thereof, said pawl lock portion being under said cam follower, said blocker means boss being near the bottom of said slide and movable out from under said lock portion when said slide is pushed rearwardly from said rest position.

* * * * *